United States Patent [19]

Sloan

[11] 4,390,305

[45] Jun. 28, 1983

[54] PORTABLE HOT WATER SYSTEM FOR DIVER'S SUIT

[76] Inventor: Albert H. Sloan, 4200 Kean Rd., Fort Lauderdale, Fla. 33314

[21] Appl. No.: 224,007

[22] Filed: Jan. 12, 1981

[51] Int. Cl.[3] ..... B63C 11/02; A61F 7/06

[52] U.S. Cl. ..... 405/186; 126/210; 405/190

[58] Field of Search ..... 405/185–194; 126/204, 208, 210

[56] References Cited

U.S. PATENT DOCUMENTS

| | | | |
|---|---|---|---|
| 3,762,392 | 10/1973 | Long | 126/210 |
| 4,013,122 | 3/1977 | Long | 126/210 X |
| 4,167,932 | 9/1979 | Zebuhr | 126/208 |
| 4,208,152 | 6/1980 | Colston | 405/186 |

*Primary Examiner*—Dennis L. Taylor
*Attorney, Agent, or Firm*—James E. Nilles

[57] ABSTRACT

Portable apparatus for supplying hot water to a diver's suit and which has a portable water pump that can be located closely adjacent a water source so as to minimize the lift required by the pump, a compressed air source that normally furnishes compressed air to the breathing apparatus of the diver and which is also used to drive the water pump by means of an air motor, a portable water heater having a source of fuel for heating the water is connected to the discharge side of the water pump for receiving cold water and heating it, the hot water is discharged from the heater and is mixed with cold water to the desired temperature and then furnished to the diver's suit. All of the components of the apparatus are portable and the entire system is flexible as to its location and set-up, there being no fixed apparatus or installations required. The water pump is operated by the air compressor which furnishes compressed air to the breathing apparatus of the diver and the pump can be remotely located from the heater and is located adjacent the water source so that the net positive suction head required by the pump is satisfied. The pump is also pressure compensated so that the pressure can be set and the pump will supply the amount of water at a particular pressure on demand, and the air consumption of this positive displacement pump is limited to a reasonable amount and does not unduly burden the diving system. With the present apparatus a minimum number of components are required and the entire arrangement is highly portable and easily assembled and disassembled.

3 Claims, 4 Drawing Figures

PORTABLE HOT WATER SYSTEM FOR DIVER'S SUIT

BACKGROUND OF THE INVENTION

The present invention relates to apparatus for providing hot water for divers' suits. Pumping hot water to divers' suits is conventional but heretofore the equipment for such heating apparatus was cumbersome, required permanent installations or required complicated and extensive back-up systems such as ships or barges and was not easily portable, often requiring additional engines or additional electric or steam supply which were difficult to move from one installation to another. See for example U.S. Pat. No. 4,208,152 issued June 17, 1980 and the references cited therein.

SUMMARY OF THE PRESENT INVENTION

The present invention provides portable apparatus for supplying hot water to a diver's suit including a portable water pump that can be located closely adjacent a water source so as to minimize the lift required by the pump, a compressed air source that normally furnishes compressed air to the breathing apparatus of the diver and which is also used to drive the water pump by means of an air motor, a portable water heater having a source of fuel for heating the water is connected to the discharge side of the water pump for receiving cold water therefrom, the hot water is discharged from the heater and is mixed with cold water to the desired temperature and then furnished to the diver's suit. All of the components of the apparatus are portable and the entire system is flexible as to its location and set-up, there being no fixed apparatus or installations required. The water pump may be operated by the same air compressor which furnishes compressed air to the breathing apparatus of the diver and the pump can be remotely located from the heater and located adjacent the water source so that the net positive suction head required by the pump is satisfied. The pump is also pressure compensated so that the pressure can be set and the pump will supply the amount of water at a particular pressure on demand, and the air consumption of this positive displacement pump is limited to a reasonable amount and does not unduly burden the diving system. With the present apparatus, a minimum number of components are required and the entire arrangement is highly portable and easily assembled and disassembled.

DESCRIPTION OF A PREFERRED EMBODIMENT

Figure 1:
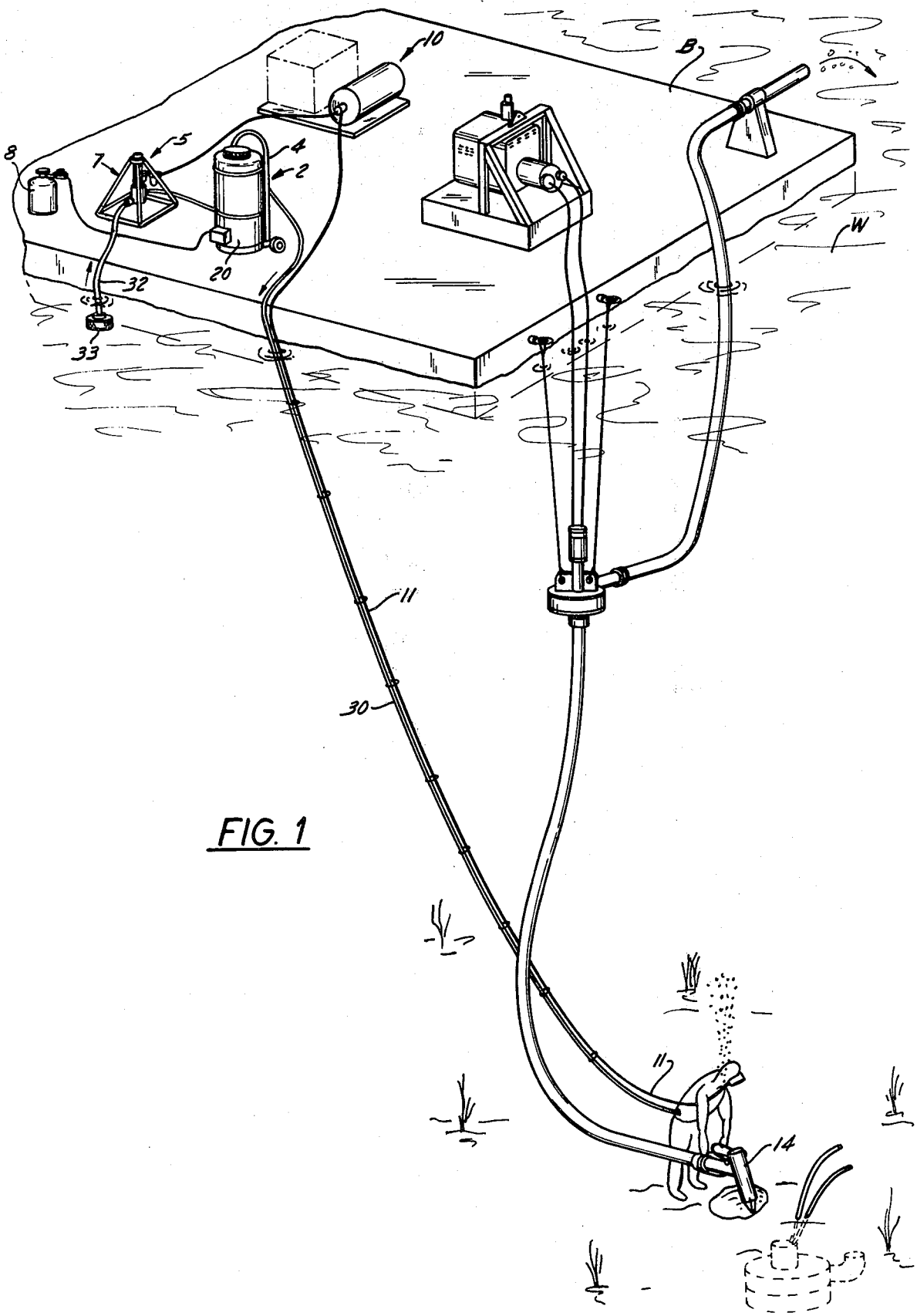
FIG. 1 is a perspective view of the general arrangement of the hot water water for divers showing it used in connection with a barge on which there is also located a hand dredge head apparatus.
Figure 2:
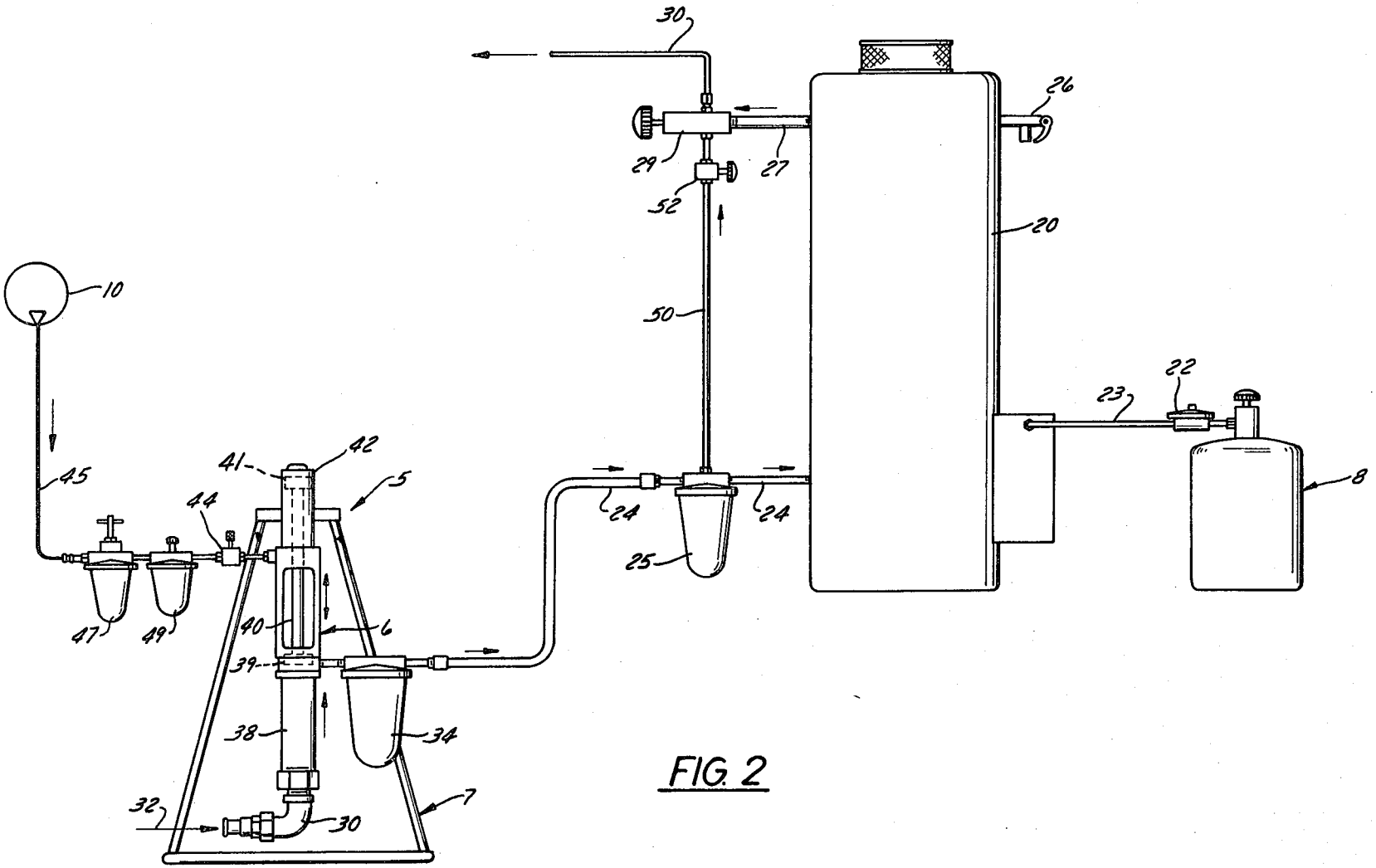
FIG. 2 is a schematic diagram of the hot water apparatus shown in FIG. 1, some of the parts being eliminated for the sake of clarity in the drawings and the view being on an enlarged scale from that shown in FIG. 1.
Figure 4:
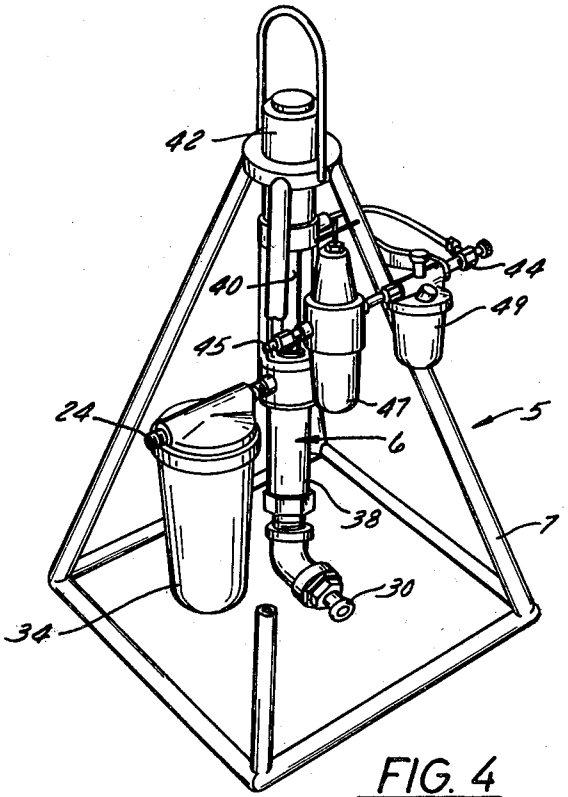
FIG. 4 is a perspective view of the portable air driven water pump assembly as shown in FIGS. 1 and 2, certain parts being shown as broken away or removed for the sake of clarity in the drawings.
Figure 3:
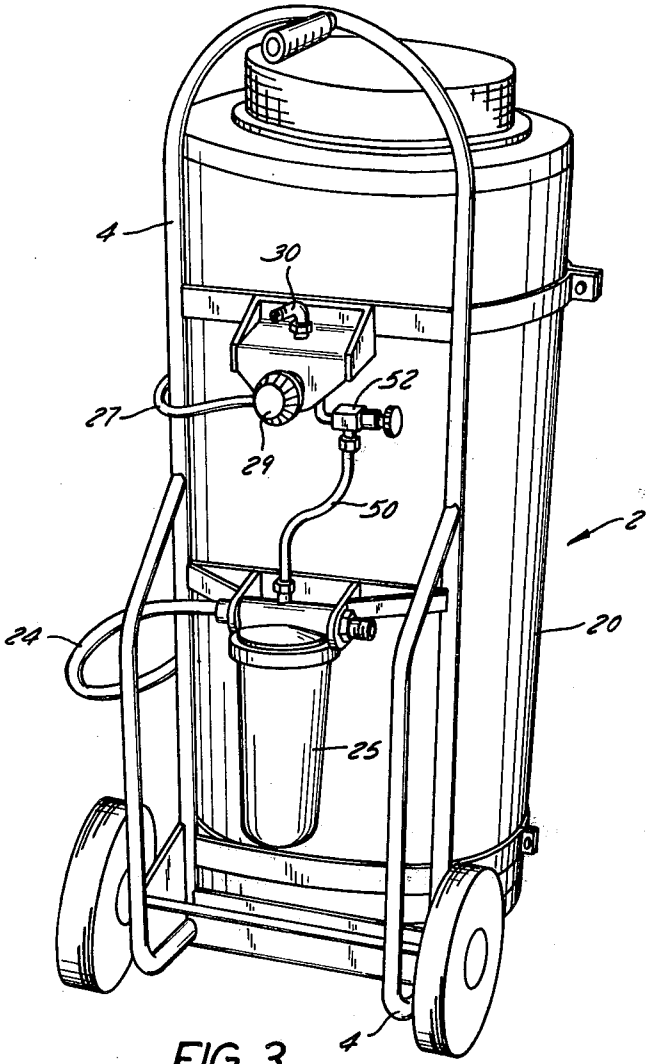
FIG. 3 is an enlarged, perspective view of the portable water heater assembly.

The invention has been shown in FIG. 1 as used on a barge and in conjunction with a diver that is operating a hand held dredge head 14. It should be understood that the portable components of the present water heating apparatus are highly portable and their disposition and location are consequently very flexible. The apparatus includes a water heater assembly 2 which as shown in FIG. 3 includes a wheel carriage 4 rendering it highly portable. A water pump assembly 5 includes an air driven water pump 6 mounted on a portable stand 7 that provides a good base that permits it to be mounted in a stable manner without being required to be secured to the barge, boat or the like. The general organization of the apparatus also includes a source of water heating fuel such as a bottle of propane gas 8, but of course other forms of fuel, such as kerosene, diesel fuel or jet fuel could also be used. A bottle of natural gas or propane is convenient and experience has shown that a 100 pound bottle will last about two weeks under normal diving conditions. An engine driven air compressor 10 is located on the barge and it is of itself conventional in nature and is ordinarily used in diving equipment to furnish compressed air via line 11 to the breathing apparatus of the diver as indicated in FIG. 1.

While it forms no part of the present invention, the hand operated dredge head 14 has been shown as being used by the operator and if further reference to its operation or component parts is deemed to be either necessary or desirable, reference may be had to my co-pending U.S. patent application Ser. No. 222,742 filed Jan. 5, 1981, which issued as U.S. Pat. No. 4,352,251 on Oct. 5, 1982.

Referring in greater detail to the portable components that form the hot water apparatus of the present invention, the water heater assembly 2 includes a conventional, glass lined water heater 20 which is mounted on the wheeled frame 4 and which has the source of fuel 8 connected thereto via regulator 22 and conduit 23 and for heating the water in the heater 20 in the known manner. The heater has a cold water inlet conduit 24 in which is mounted a filter 25 and by means of which cold water can be received by the heater from the water pump 6. The hot water heater also includes a pressure relief valve 26 and a hot water discharge conduit 27 which conducts the hot water from the heater, through a manually regulated thermostatic valve 29 and via conduit 30 to the diver's suit.

The water pump 6 is driven by compressed air, is pressure compensated, and is of the positive displacement type. The pump has a water inlet 30 for receiving cold water from a water source, such as the water W on which the barge B of FIGS. 1 floats. It will be noted that the portable pump 6 is located closely adjacent the water source and conduit 32 leads from the inlet screen 33 in the water source to the inlet of the pump. By locating the pump closely adjacent the water source, the lift head of the pump is minimized and the net positive suction head required by the pump is satisfied. A water filter 34 is located on the pump assembly and in the conduit 24 leading to the hot water heater. The pump 6 includes the cylinder 38 in which a plunger 39 is reciprocated by the rod 40 which is connected to the air driven piston 41 of the air motor 42. A speed control valve 44 regulates the amount of compressed air delivered via conduit 45 from the air compressor 10 and thereby regulates the water discharge rate of the pump 6. A filter 47 is interposed in the air line 45 as is an oiler 49.

A cold water bypass conduit or line 50 is connected between the discharge of the pump 6 and the hot water discharge of the hot water heater and the cold water conducted via line 50 is mixed with the hot water discharged by the water heater by means of a mix valve 52. Thus the temperature of the water delivered to the diver's suit can be regulated to, for example 102° F.

The apparatus of the present invention is highly portable and is quickly connected and disconnected and can be readily packed and transported to the diving site. The filters provided along with the sedementation filtration of the heater itself permits the use of dirty water and in fact even sewage. The apparatus permits the hook-up to any source of water, such as the ocean itself, or a supply of city water if it were nearby. By making the water pump highly portable it can be located adjacent the cleanest portion of the available water.

With the present apparatus, the pump can be located as close to the water source as possible and then a long hose, for example several hundred feet can be used to connect the heater to the pump and the heater can be mounted in any convenient location.

With the above apparatus, the water is fed into the heating tank and an electric control system heats the water to some desired temperature, 165° F. often being sufficient, and a mixing valve mixes cold water with the hot water to produce the temperature desired by the diver. The diver may have a dump valve in his suit to permit bypass of the hot water in the event that becomes necessary.

I claim:

1. A portable hot water system for a diver's suit and comprising a portable, air driven, pressure compensated, positive displacement water pump, said pump having a water inlet for receiving cold water and also having a pressurized water outlet, said portable pump being positionable adjacent said water source and having a cold water inlet conduit connected to its water inlet and for conducting cold water from a water source into said pump, an engine driven portable air compressor connected with and for driving said pump by compressed air, a portable water heater, a portable container of heating fuel which is connected with and for heating said heater, a cold water conduit between said water outlet of said pump and said water heater for supplying cold water to said heater, a hot water conduit from said hot water heater to the suit of a diver, and a thermostatic valve located in the water conduit between said water heater and said diver's suit.

2. A portable hot water system for a diver's suit and comprising a portable, air driven, pressure compensated, positive displacement water pump, said pump having a water inlet for receiving cold water and also having a pressurized water outlet, said pump having a cold water inlet conduit connected to said pump water inlet and for conducting cold water from a water source into said pump, said portable pump being positionable adjacent said water source to thereby minimize the lift head required of said pump, a water filter between said water source and said pump, an air compressor for furnishing compressed air to breathing apparatus of the diver, said compressor connected to and for driving said pump by compressed air, a portable water heater having a source of fuel for heating the water therein, a cold water conduit between said water outlet of said pump and said water heater for supplying cold water to said heater, a water filter between said pump and said heater, said heater having a hot water outlet, a hot water conduit from said hot water outlet to the suit of a diver, a thermostatic valve located in the water conduit between said water heater and said diver's suit, a cold water bypass line between said water outlet of said pump and said hot water conduit from said heater, a mix valve in said cold water bypass line for regulating the amount of cold water to be mixed with the hot water discharged from said heater, and a speed control valve for said pump to regulate the rate of flow of water discharged therefrom.

3. A portable hot water system for a diver's suit and comprising a portable and self-supporting pump assembly, said assembly including an air driven, pressure compensated, positive displacement water pump, said pump having a water inlet for receiving cold water and also having a pressurized water outlet, a speed control valve for said pump to regulate the rate of flow of water discharged therefrom, said pump having a cold water inlet conduit connected to said pump water inlet and for conducting cold water from a water source into said pump, said portable pump assembly being positionable adjacent said water source to thereby minimize the lift head required of said pump, a water filter between said water source and said pump, an air compressor for furnishing compressed air to breathing apparatus of the diver, said compressor connected to and for driving said pump by compressed air, a portable water heater having a source of fuel for heating the water therein, a cold water conduit between said water outlet of said pump and said water heater for supplying cold water to said heater, water filter means between said pump and said heater, said heating having a water outlet, a water conduit from said water outlet of said heater for conveying warm water to the suit of a diver, a thermostatic valve located in the water conduit between said water heater and said diver's suit, a cold water bypass line between said water outlet of said pump and said water conduit from said heater, a mix valve for regulating the amount of cold water to be mixed with the water discharged from said heater.

* * * * *